United States Patent [19]

Price et al.

[11] 4,319,664

[45] Mar. 16, 1982

[54] REMOTELY CONTROLLED OIL DRAIN VALVE

[76] Inventors: Ralph J. Price, 7636 Upper Miamisburg Rd., Miamisburg, Ohio 45342; Jack Albert, 3608 Hertland Dr., Kettering, Ohio 45439

[21] Appl. No.: 126,426

[22] Filed: Mar. 3, 1980

[51] Int. Cl.[3] ..... F01M 11/04; F16K 31/46

[52] U.S. Cl. ..... 184/1.5; 251/181; 251/294; 251/309; 251/313

[58] Field of Search ..... 184/1.5; 137/351; 251/294, 309, 313, 181

[56] References Cited

U.S. PATENT DOCUMENTS

| | | | |
|---|---|---|---|
| 513,319 | 1/1894 | Harding | 251/313 X |
| 1,963,872 | 6/1934 | Sheaffer | 251/313 X |
| 1,995,174 | 3/1935 | Gerrard et al. | 184/1.5 X |
| 2,505,145 | 4/1950 | Ryan | 251/313 X |
| 2,678,801 | 5/1954 | Bradbury | 251/181 |
| 3,195,856 | 7/1965 | Arrison | 251/181 |
| 3,310,133 | 3/1967 | Eaker | 184/1.5 |
| 3,477,459 | 11/1969 | Schosson | 184/1.5 X |
| 3,537,679 | 11/1970 | McCarthy et al. | 251/294 X |
| 3,650,352 | 3/1972 | Schwory | 184/1.5 |
| 3,664,633 | 5/1972 | Schaffner | 251/294 |
| 3,677,369 | 7/1972 | Schramm | 184/1.5 |
| 3,871,483 | 5/1975 | Espinosa et al. | 184/1.5 |
| 3,954,250 | 5/1976 | Grace | 184/1.5 X |
| 4,086,981 | 5/1978 | Mitsui | 184/1.5 |

FOREIGN PATENT DOCUMENTS

| | | | |
|---|---|---|---|
| 37635 | 6/1927 | Denmark | 251/313 |
| 2143265 | 3/1973 | Fed. Rep. of Germany | 184/1.5 |

*Primary Examiner*—David H. Brown

[57] ABSTRACT

A remotely controlled oil drain valve device to be installed in the threaded drain plug opening of automotive crankcase permitting drainage of crankcase oil without removal of the crankcase plug. A cylindrical tapered valve core having cylindrical arms extending from end surfaces of said cylindrical tapered valve core and being seated in a cylindrical tapered valve seat opening of a cylindrical valve body having an affixed threaded tubular nipple extending radially from said cylindrical valve body, and a disk-shaped cable bracket yoke having an extended arm affixed selectively to said cylindrical valve body by means of threaded fasteners. A cable control arm affixed radially to said cylindrical tapered valve core which, when activated by a remotely located cable control mechanism affixed to a mounting bracket, initiates rotational movement of said cylindrical tapered valve core simultaneously overcoming the action of the return spring, thereby facilitating the registration of the diametrical openings in said cylindrical valve body with the diametrical opening of said cylindrical tapered valve core effecting the drainage of oil from said automotive crankcase.

2 Claims, 4 Drawing Figures

1
2
3
4
5
6
7
8
9
10
11
12
17
18
23
25
26
32
34
36
43
44

REMOTELY CONTROLLED OIL DRAIN VALVE

It is believed that functional, practical, and applicable aspects of our invention will now be apparent to those in these arts. We have provided an oil drain valve capable of being mounted operably within all existing automotive crankcase openings for the drainage of automotive crankcase oil, as well as providing a remote control means by which operation of said valve is effected, resultantly eliminating present day laborious methods of draining automotive crankcase oil. It should be understood that the present disclosure has been made only by way of example and that numerous changes in detail of construction and combination and arrangement of parts may be resorted to without departing from the true spirit and scope of the invention as hereinafter claimed.

BACKGROUND OF THE INVENTION

This invention relates to a Remotely Controlled Oil Drain Valve device which functionally permits drainage of dirty, contaminated oil from an automotive crankcase without the prior manual removal of a crankcase plug which heretofore necessitated both manual removal and manual replacement of said crankcase plug either involving the use by the vehicle owner of extra specialized equipment needed for the lifting of the vehicle for ease of access or involving alternative added expense to the owner for such specialized services. This invention features improvements over the prior art in respect to: adaptability in relation to ease of positioning of both the valve cable control arm and the cable bracket yoke to accommodate all existing drain opening positions, a gasket-free tapered sealing valve thereby effectively eliminating need of gasket replacement resultantly eliminating added replacement costs to purchaser, a dual means assuring a positive closed position of said oil drain valve, and an adaptable means by which the remotely controlled flexible cable is flexibly affixed to said oil drain valve thereby effecting automatic adjustments to pressures exerted externally on said cable thus preventing an accidental activation of said oil drain valve.

In the past, oil drain valves have not been widely accepted by the public, the above mentioned fact of which may be attested to by the unavailability of said oil drain valves in the common market places: however, due to recent inflationary trends and oil conservation needs, this invention fulfills a present-day societal need and promises to become a possible financial boon to the masses thereby subsequently serving a distinct and desirable purpose in the society.

Additional advantages and features of said invention will become apparent in the following description.

BRIEF DESCRIPTION OF THE DRAWING

Other objects and further details, of that which we believe to be our invention, will become clear from the following description and claims taken with the accompanying drawing, wherein;

DESCRIPTION OF THE PREFERRED EMBODIMENT

Figure 1:
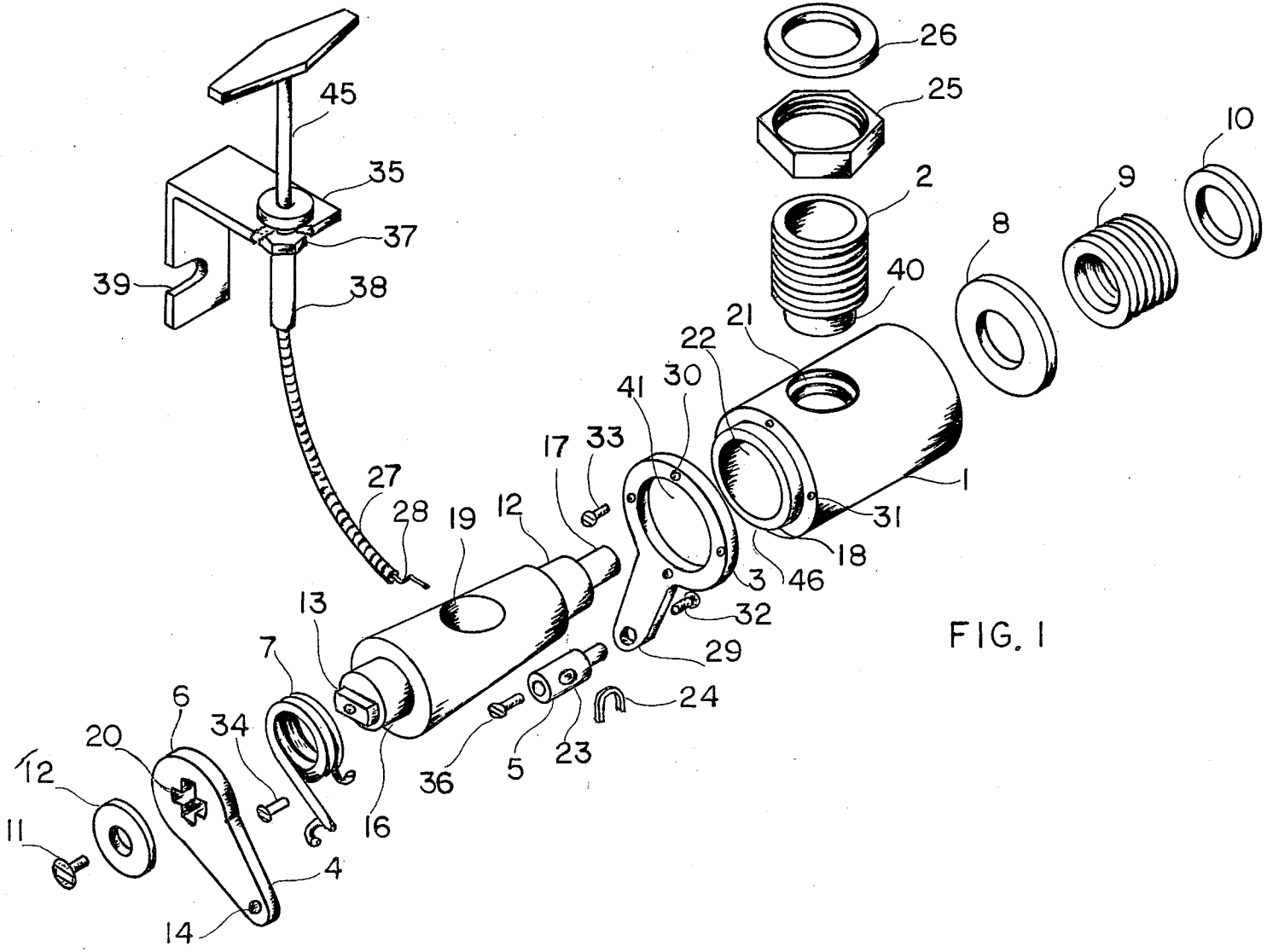
FIG. 1 is an exploded view showing the complete structure of the Remotely Controlled Oil Drain Valve and the flexible cable control assembly.
Figures 2, 2A:
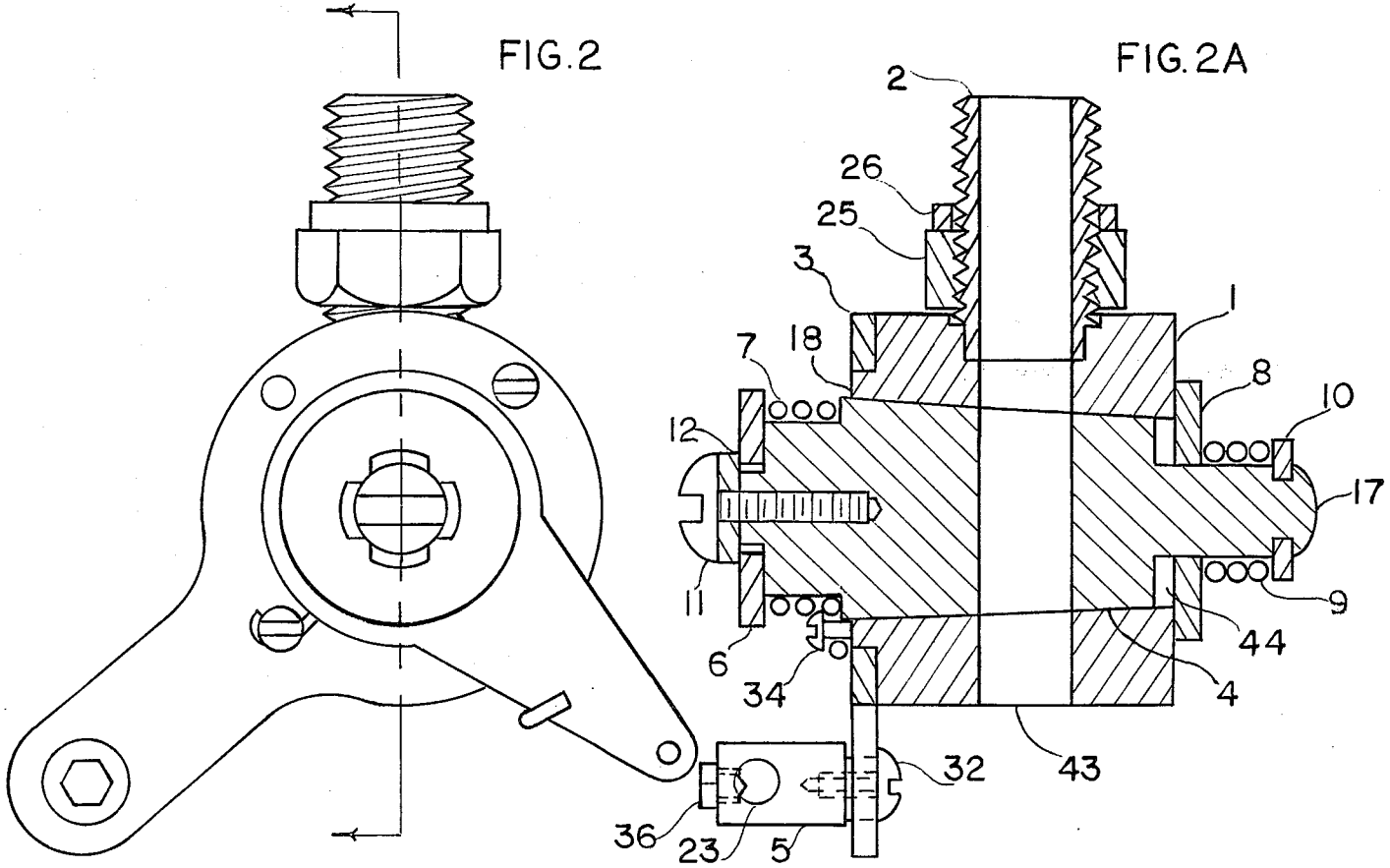
FIG. 2-A is a sectional view taken along the cutting plane line of FIG. 2 showing the cylindrical tapered valve core turned from the closed to the open position and depicting the formed crown rivet and take-up void of said Remotely Controlled Oil Drain Valve.
Figure 3:
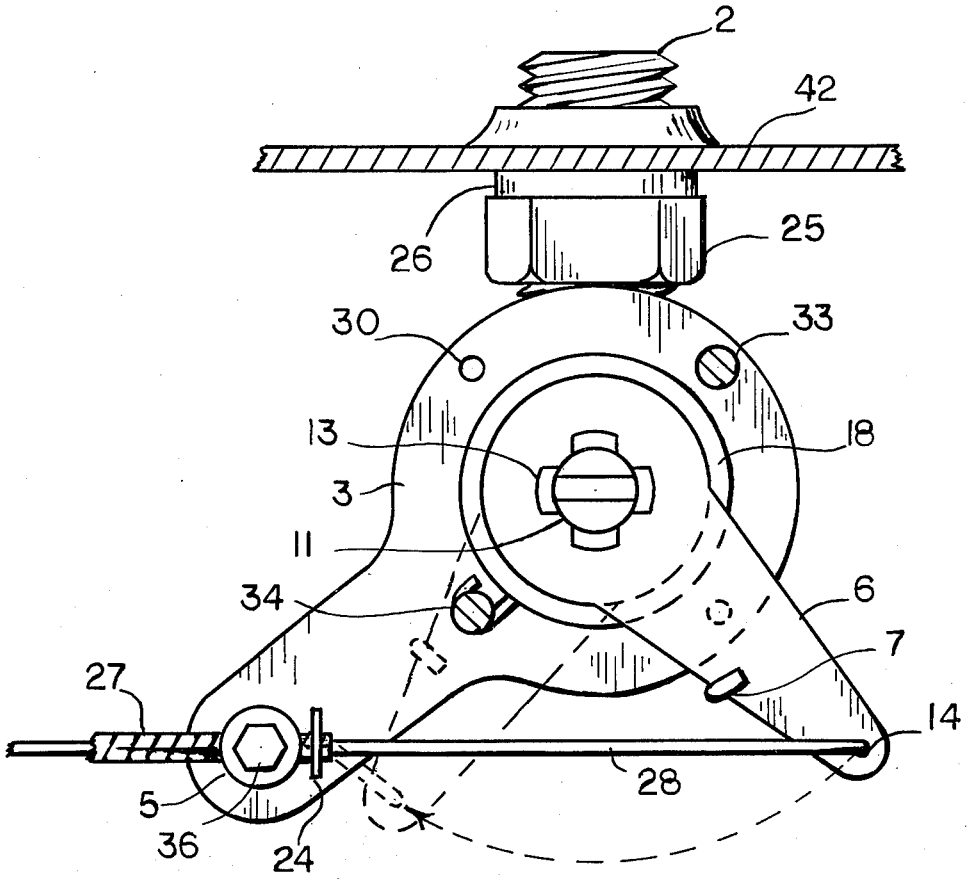
FIG. 3 is a fragmentary elevational view of said Remotely Controlled Oil Drain Valve illustrating (in phantom view) the rotational activation of the cable control arm.

Turning now to the drawing, there is illustrated in FIG. 1 an exploded view showing both a flexible cable control assembly and the complete structure of the Remotely Controlled Oil Drain Valve device for permanent installation on an automotive crankcase 42, the embodiment of said Remotely Controlled Oil Drain Vlave device including: a cylindrical valve body 1 consisting of a tubular shoulder 18 extending from one end thereof, a cylindrical tapered opening 22 piercing said cylindrical valve body 1 therein, a stepped dual diametrical opening 21 extending radially through said cylindrical valve body 1, and two threaded openings 31 and 46 for securing a cable bracket yoke 3 around the tubular end to said cylindrical valve body 1 by means of threaded fasteners 33 and 34; a threaded tubular nipple 2 having a lesser diametrical cylinder 40 extending from one end thereof and insertably compressed into said stepped dual diametrical opening 21 and said threaded tubular nipple 2 being affixed permanently by brass welding means therein subsequently affording a means whereby said cylindrical valve body 1 may be secured into selective position by means of a gland nut 25 after threaded end of said threaded tubular nipple 2 is fed into the existing threaded crankcase opening thereby compressing between said crankcase surface and topical surface of said gland nut 25 a fiber gasket 26 positionally affording by means of said compression a leakproof means of union; a cylindrical tapered valve core 4 having a tenon-ended cylindrical arm 16 extending from the large end of said cylindrical tapered valve core 4, a tang-ended cylindrical arm 15 extending from the smaller end thereof, and a diametrical opening 19 radially passing through said tapered valve core 4 for purpose of registration of said diametrical opening 19 with the diametrical opening of said threaded tubular nipple 2 and the diametrical valve body opening 43 of said cylindrical valve body 1 when insertably seated within said cylindrical tapered opening 22 of said cylindrical valve body 1, thus affording a means by which fluid may pass from said automotive crankcase 42 and also affording, by means of a 90° rotation of said valve core 4, a means by which passage of fluid from said automotive crankcase 42 may be restricted and thereby retained within said automotive crankcase 42.

It should be specifically noted that the length of said cylindrical tapered opening 22 within said cylindrical valve body 1 being greater in length than the insertion length of said cylindrical tapered valve core 4 serves in effectively providing a take-up void 44 between the flat surface of the small end of the said cylindrical tapered valve core 4 and the face of the retention washer-like disk 8 mounted against the flat end surface of said cylindrical valve body 1 and encircling said tang-ended cylindrical arm 15 thus affording the necessary movement space for said tapered cylindrical valve core 4 thereby permitting maintenance of a gasket-free constant seal between the internal and external surfaces of said cylindrical tapered valve core 4 and said cylindrical valve body 1 when a constant draw-in force is exerted upon said joining parts by means of said retention washer-like disk 8 which, being greater in diameter than that of the small end opening of said tapered cylindrical opening 22 and which, being mounted on said tang-ended cylindrical arm 15 in which, being compressed against the face of said cylindrical valve body 1 by the exerted force of a partially compressed compression spring 9 mounted on said tang-ended cylindrical arm 15 and which, due to mechanical conversion of the greater part of said tang-ended cylindrical arm 15 to a crown rivet head 17 with resultant compression movement of the spring retaining washer 10 and the resultant partial compression of said compression spring 9, is instrumental in conjunction with said cylindrical valve body components in effecting a permanent constant draw in seating pressure on said cylindrical tapered valve core 4.

It should be further noted that the retaining of said cylindrical tapered valve core 4 in a non-draining position is effected by means of a return spring 7, said return spring 7 being mounted on said tenon-ended cylindrical arm 16 of the said cylindrical tapered valve core 4 between the cable control arm 6 and the large end of said cylindrical tapered valve core 4, and said return spring 7 providing two extending arms having hooked ends thereby providing a means by which the affixing of said hooked ends to said cable control arm 6 and to cylindrical valve body 1 by means of said threaded fastener 33 is effected; assuring the continued proper seating between the diametrical valve body opening 43 and said cylindrical tapered valve core 4, the large end section of said cylindrical tapered valve core 4 projects beyond the length of said tubular shoulder 18 which extends from said cylindrical valve body 1 permitting freedom of inward and rotational movement of said cylindrical tapered valve core 4.

Structurally affixed to tenon 13 of said cylindrical tapered valve core 4 by means of a threaded fastener 11 inserted into a threaded opening of said tenon-ended cylindrical arm 16 is positioned said cable control arm 6 comprising a disk-shaped body having an extended arm and two elongated slotted openings 20 centrally located and piercing said disk-shaped body of said cable control arm 6, each said elongated slotted opening 20 crossing centrally the other said elongated slotted opening 20 resultantly positioning said elongated slotted openings 20 at a 45° angle to said extended arm and at a 45° angle to the diametrical opening 14 located at the extended end of the extending arm of said cable control arm 6 allowing, by means of said configuration of said elongated slotted openings 20, a quadra-selective positioning of said cable control arm 6 upon extended said tenon 13 of said tenon-ended cylindrical arm 16 of said cylindrical tapered valve core 4 permitting the selective manual rotation of said cylindrical tapered valve core 4 thus effecting alignment of said diametrical opening 19 of said cylindrical tapered valve core 4 and said diametrical valve body opening 43 of said cylindrical valve body 1 with said diametrical opening of said threaded tubular nipple 2 thereby controlling the drainage of fluids from said automotive crankcase 42.

Affording a means of anchoring a flexible cable control to said cylindrical valve body, said cable bracket yoke 3 affixed to said cylindrical valve body 1 is secured in place by said threaded means 33 and 34 passing through diametrical openings 30 around a diametrical bore opening 41 of the disk-shaped body of said cable bracket yoke 3, said diametrical bore opening 41 being of sufficient diameter as to permit a slidable mounting of said cable yoke 3 onto and circumscribing said tubular shoulder 18 of said cylindrical valve body 1; affording a means by which a stepped diametrical cable locking cylinder 5 is insertably secured to said cable bracket yoke 3, a stepped diametrical cable locking cylinder tang, said tang being greater in length than the thickness of said cable bracket yoke 3 structurally permits free rotational movement of said stepped diametrical cable locking cylinder 5 when said stepped diametrical cable locking cylinder 5 is affixed to said cable bracket yoke 3 by threaded means 32; affording a means by which said cable control arm 6 may rotate said cylindrical tapered valve core 4 90°, the hooked end of a cable control wire 28 affords a means by which the flexible cable 27 is secured in operative position when said hooked end of said cable control wire 28 is inserted into said diametrical opening 14 of said cable control arm 6 and secured to said stepped diametrical cable locking cylinder 5 when said flexible cable 27 is affixed in position by means of a threaded fastener 36 and a cable retaining clip 24 thereby affording a means of rotationally activating said cylindrical tapered valve core 4 when said cable control arm 6 is rotationally activated by manual force, the aforementioned said rotation being contingent upon and correlative with the affixation of said cable control arm 6 to said cable control wire 28 of said flexible cable 27 said flexible cable 27 being secured to a cylindrical shouldered threaded sheath 38 said cylindrical shouldered threaded sheath 38 passing through a diametrical opening of one arm of an L-shaped bracket 35 and being positionally secured by a threaded fastener 37 said threaded fastener 37 positionally securing said cylindrical shouldered threaded sheath 38 to said L-shaped bracket 35 said L-shaped bracket 35 having a round-bottomed slot 39 for the securing of said L-shaped bracket 35 in any convenient location interiorly or under the hood of any automotive vehicle by manual manipulation of a T-handled plunger 45 housed within said cylindrical shouldered threaded sheath 38 and affixed within an opening within the end of said T-handled plunger 45 and said flexible cable control assembly being remotely positioned from said oil drain valve.

HOW THE INVENTION IS OPERATED OR USED

The Remotely Controlled Oil Drain Valve Device is installed threadedly in the threaded drain plug opening of an automotive crankcase pan (42), said device being selectively positioned and secured to said automotive crankcase pan (42) by means of a tightening force manually exerted to the selectively positioned hexagonal gland nut (25) of said device.

The operation of said Remotely Controlled Oil Drain Valve Device is accomplished by means of a manually-applied lifting force exerted upon the T-handled plunger (45) causing a resultant retractive pull to be exerted upon the sheathed cable control wire (28) of the flexible cable (27) resultantly and simultaneously, by means of said cable control wire (28) being insertably affixed to the cable control arm (6) and by means of the distal end of said flexible cable (27) being secured positionally to said Remotely Controlled Oil Drain Valve Device, casually effecting: the drawing of said cable control arm (6) through a 90° arc thus functionally overcoming the action of the return spring (7) which positionally retains said Remotely Controlled Oil Drain Valve Device in a normally closed position; the initiation of a rotational movement of the cylindrical tapered valve core (4); the facilitating of the registration of the diametrical opening (43) in said cylindrical tapered valve core (4); the resultant drainage of fluid from said automotive crankcase pan (42) by means of gravitational force.

Sequentially following the completion of said fluid-drainage action, a manually-applied depression of said T-handled plunger (45) subsequently facilitates the returning of said cylindrical tapered valve core (4) to a normally closed position.

We claim:

1. A Remotely Controlled Oil Drain Valve device for permanent installation on any automotive crankcase, said device comprising a threaded tubular nipple with a structurally-provided lesser diametrical cylinder and functionally being threadedly receivable in the threaded opening located in the bottom of any said automotive crankcase and thereby being secured in position selectively by means of a fiber gasket and a gland nut, said lesser diametrical cylinder being permanently insertably mounted and affixed within a stepped dual diametrical opening of a cylindrical valve body by means of braized welding, said cylindrical valve body being comprised of a cylindrical body having a stepped dual diametrical opening extending radially through said cylindrical valve body, a tubular shoulder extending from one end of said cylindrical valve body thereof, a cylindrical tapered opening piercing said cylindrical valve body therein, two threaded openings for the purpose of facilitating the securing of a cable bracket yoke around said tubular shoulder and to said cylindrical valve body by means of threaded fasteners, said cylindrical tapered opening providing for insertion of a cylindrical tapered valve core, said cylindrical tapered valve core being comprised of a conical shaped body having a diametrical opening for purpose of alignment into registry with said threaded tubular nipple opening and diametrical valve body opening of said cylindrical valve body by means of rotation of said cylindrical tapered valve core thereby communicating the interior of said automotive crankcase with the exterior environment of said cylindrical tapered valve core being further comprised of a tenon-ended cylindrical arm extending from the large end of said cylindrical tapered valve core and being secured within said cylindrical tapered opening provided in said cylindrical valve body by means of a retention washer, a tang-ended cylindrical arm extending from the smaller end of said cylindrical tapered valve core thereof, said retention washer mounted on said tenon-ended cylindrical arm of said cylindrical tapered valve core and in effect being pressed against the shoulder end of said cylindrical valve body by a partially compressed compression spring, said compression spring mounted on said tang-ended cylindrical arm of said cylindrical tapered valve core and compressedly affixed between said retention washer and said retention spring by means of mechanical conversion of the greater portion of the tang of the tang-ended cylindrical arm into a crown rivet head thereof, said tenon-ended cylindrical arm of said cylindrical tapered valve core, a tenon with a threaded diametrical opening for the securing of a cable control arm over the tenon end of said tenon-ended arm by means of a threaded fastener and disk-shaped washer, said cable control arm having a disk-shaped body with an extended arm and two elongated slotted openings being centrally located on the disk section of said cable control arm and being positioned at a 45° angle to both the extended arm and the diametrical opening of said cable control arm which structurally incorporates said disk-shaped body which being threadedly secured to said tenon-ended cylindrical arm thereby provides a retaining shoulder thus retaining a return spring upon said tenon-ended cylindrical arm and further retaining said return spring between said cable control arm and the shoulder of said cylindrical tapered valve core, said return spring comprised of a coil spring having a hook-ended arm extending from each end of said return spring thereof for the utilizing of the hooked end of one arm of said return spring for purpose of cradling the lower edge of the extended arm of said cable control arm and for the securing of the other hooked end of said return spring to the cable bracket yoke by means of a threaded fastener, said threaded fastener piercing a diametrical opening of said cable bracket yoke, said cable bracket yoke circumscribing said tubular shoulder of said cylindrical valve body and comprising a disk-shaped body having four diametrical openings circumscribing a diametrical bore opening and further comprising an extended arm having a diametrical opening wherein a stepped diametrical cable locking cylinder is affixed by means of a threaded fastener, said stepped diametrical cable locking cylinder rotatably affixed to and secured within said diametrical opening of the extended arm of said cable bracket yoke by means of a threaded fastener threadedly receivable in a threaded diametrical opening of said stepped diametrical cable locking cylinder for the securing positionally of a flexible cable by means of a threaded fastener when said flexible cable is insertably mounted within the radially positioned diametrical opening of said stepped diametrical cable locking cylinder therein selectively securing said flexible cable by means of a threaded fastener, said flexible cable providing a housing for a cable control wire, said cable control wire being housed within said flexible cable and being structurally equiped with one unhoused hooked end insertably mounted within said diametrical opening of said cable control arm and the other end being connected to a T-handled plunger, a U-shaped clip being affixed by slidable means to the distal end of said flexible cable and thereby assuring the prevention of an accidental retraction of said cable control wire in the event of an accidental activation of said oil drain valve by means of impactive forces exerted upon said flexible cable.

2. A Remotely Controlled Oil Drain Valve device for permanent installation on any automotive crankcase, said device comprising a threaded tubular nipple with a structurally-provided lesser diametrical cylinder and functionally being threadedly receivable in the threaded opening located in the bottom of any said automotive crankcase and thereby being secured in position selectively by means of a fiber gasket and a gland nut, said lesser diametrical cylinder being permanently insertably mounted and affixed within a stepped dual diametrical opening of a cylindrical valve body by means of braized welding, said cylindrical valve body being comprised of a cylindrical body having a stepped dual diametrical opening extending radially through said cylindrical valve body, a tubular shoulder extending from one end of said cylindrical valve body thereof, a cylindrical tapered opening piercing said cylindrical valve body therein, two threaded openings for the purpose of facilitating the securing of a cable bracket yoke around said tubular shoulder and to said cylindrical valve body by means of threaded fasteners, said cylindrical tapered opening providing for insertion of a cylindrical tapered valve core, said cylindrical tapered valve core being comprised of a conical shaped body having a diametrical opening for purpose of alignment into registry with said threaded tubular nipple opening and diametrical valve body opening of said cylindrical valve body by means of rotation of said cylindrical tapered valve core thereby communicating the interior of said automotive crankcase with the exterior environment and said cylindrical tapered valve core being further comprised of a tenon-ended cylindrical arm extending from the large end of said cylindrical tapered valve core and being secured within said cylindrical tapered opening provided in said cylindrical valve body by means of a retention washer, a tang-ended cylindrical arm extending from the smaller end of said cylindrical tapered valve core thereof, said retention washer mounted on said tenon-ended cylindrical arm of said cylindrical tapered valve core and in effect being pressed against the shoulder end of said cylindrical valve body by a partially compressed compression spring, said compression spring mounted on said tang-ended cylindrical arm of said cylindrical tapered valve core and compressedly affixed between said retention washer and said retention spring by means of mechanical conversion of the greater portion of the tang of the tang-ended cylindrical arm into a crown rivet head thereof, said tenon-ended cylindrical arm of said cylindrical tapered valve core, a tenon with a threaded diametrical opening for the securing of a cable control arm over the tenon end of said tenon-ended arm by means of a threaded fastener and disk-shaped washer, said cable control arm having a disk-shaped body with an extended arm and two elongated slotted openings being centrally located on the disk section of said cable control arm and being positioned at a 45° angle to both the extended arm and the diametrical opening of said cable control arm which structurally incorporates said disk-shaped body threadedly secured to said tenon-ended cylindrical arm thereby providing a retaining shoulder thus retaining a return spring upon said tenon-ended cylindrical arm and further retaining said return spring between said cable control arm and the shoulder of said cylindrical tapered valve core, said return spring comprised of a coil spring having a hook-ended arm extending from each end of said return spring thereof for the utilizing of the hooked end of one arm of said return spring for purpose of cradling the lower edge of the extended arm of said cable control arm and for the securing of the other hooked end of said return spring to the cable bracket yoke by means of a threaded fastener, said threaded fastener piercing a diametrical opening of said cable bracket yoke, said cable bracket yoke circumscribing said tubular shoulder of said cylindrical valve body and comprising a disk-shaped body having four diametrical openings circumscribing a diametrical bore opening and further comprising an extended arm having a diametrical opening wherein a stepped diametrical cable locking cylinder is affixed by means of a threaded fastener, said stepped diametrical cable locking cylinder rotatably affixed to and secured within said diametrical opening of the extended arm of said cable bracket yoke by means of a threaded fastener threadedly receivable in a threaded diametrical opening of the tang-end of said stepped diametrical cable locking cylinder and by means of a threaded fastener being threadedly receivable in the opposing end of said stepped diametrical cable locking cylinder the securing positionally of a flexible cable is effected when said flexible cable is insertably mounted within a radially positioned diametrical opening of said stepped diametrical cable locking cylinder therein selectively securing said flexible cable by means of a threaded fastener, said flexible cable control assembly comprising said flexible cable functionally providing a housing for said cable control wire having an unhoused hooked end insertably mounted within said diametrical opening of said cable control arm and the other end of said cable control wire being connected to said T-handled plunger located positionally remote from said oil drain valve and located positionally and more specifically within a cylindrical shouldered threaded sheath affixed within a diametrical opening and being secured within an L-shaped bracket opening by threaded fastener means located on the threaded shoulder section of said cylindrical shouldered threaded sheath equidistant from the distal end of said cylindrical shouldered threaded sheath which due to structural conformation allows for the affixing of said flexible cable within said distal end of said cylindrical shouldered threaded sheath by crimping means, said T-handled plunger being a component of said flexible cable control assembly and slidably affixed to said L-shaped bracket by a threaded fastener means thereby providing a remote means by which a manual lifting force may be applied to said cable control wire and through utilization of said manual lifting force thereby overriding the force of said return spring resultantly securing an open position for drainage of automotive crankcase oil, said L-shaped bracket being a component of said flexible cable control assembly and structurally comprising a round-bottomed slotted opening extending horizontally into and through the vertical leg of said L-shaped bracket for the purpose of affixing said L-shaped bracket to surfaces within the interior of an automotive vehicle or to surfaces beneath the hood of said automotive vehicle and said L-shaped bracket further comprising a diametrical opening piercing the horizontal surface of the horizontal leg of said L-shaped bracket for the securing of said flexible cable control assembly.

* * * * *